United States Patent [19]

Jablin

[11] 4,334,505

[45] Jun. 15, 1982

[54] COOLING METAL SLABS AND OTHER METAL PRODUCTS

[76] Inventor: Richard Jablin, P.O. Box 514, Winchester, Va. 22601

[21] Appl. No.: 815,744

[22] Filed: Jul. 14, 1977

[51] Int. Cl.[3] ..... F22B 1/02

[52] U.S. Cl. ..... 122/27; 148/156; 266/46; 432/77

[58] Field of Search ..... 60/653; 122/460, 483, 122/27; 266/46; 136/201; 148/156; 432/77

[56] References Cited

U.S. PATENT DOCUMENTS

| | | | |
|---|---|---|---|
| 2,540,598 | 2/1951 | Ruiz | 432/38 |
| 2,693,353 | 11/1954 | Vaughan | 134/64 R |
| 2,736,943 | 3/1956 | Cremer | 432/38 |
| 2,968,894 | 1/1961 | Hess | 65/349 |
| 2,983,497 | 5/1961 | Dailey, Jr. | 62/63 |
| 3,001,382 | 9/1961 | Mills | 62/80 |
| 3,006,979 | 10/1961 | Rich | 136/233 X |
| 3,068,586 | 12/1962 | Vaughan et al. | 34/20 |
| 3,263,738 | 8/1966 | Schwamborn et al. | 165/2 |
| 3,680,344 | 8/1972 | Manthey et al. | 134/76 |
| 3,687,145 | 8/1972 | Schrader et al. | 134/114 |
| 3,895,498 | 7/1975 | Manthey et al. | 62/64 |
| 3,897,230 | 7/1975 | Taylor et al. | 62/266 |
| 3,940,961 | 3/1976 | Gilvar | 266/102 |
| 3,983,846 | 10/1976 | Patten | 122/460 X |
| 4,012,191 | 3/1977 | Lisankie et al. | 432/179 |
| 4,075,978 | 2/1978 | Friedrich et al. | 122/483 X |

*Primary Examiner*—Leland A. Sebastian

*Attorney, Agent, or Firm*—Finnegan, Henderson, Farabow, Garrett & Dunner

[57] ABSTRACT

A process and apparatus for absorbing heat from the cooling of metal slabs and other metal products following rolling, casting, or other heating to shape the metal products, and the converting of the heat to a useful form of energy. During the process of cooling the metal products, heat from the metal is transferred to an absorbing medium by means of radiant and convective or conductive heat transfer. The absorbing medium may be water which is converted to steam. The apparatus includes necessary piping, circulating fan, steam drum, pumps and heat insulation.

10 Claims, 5 Drawing Figures

COOLING METAL SLABS AND OTHER METAL PRODUCTS

BACKGROUND OF THE INVENTION

The present invention relates to the cooling of metal slabs and other metal products and to a process and apparatus for converting the energy which is released in the cooling process into a useful form.

In a typical metal processing facility such as an iron and steel mill, intermediate products such as semi-finished steel in the form of slabs, billets, blooms, castings, and so forth, are produced as part of the overall production process. These products, as well as the finished products, are produced either by rolling, by casting, or from various heated operations. In whatever manner they are produced, they are usually allowed to cool to approximately room temperature prior to subsequent rolling operations, finishing operations, or shipping. The purpose of this cooling is to facilitate their surface inspection and conditioning as well as to facilitate their subsequent handling. This cooling is normally accomplished in such a manner that the thermal energy is lost.

An example of this waste of energy occurs in the cooling of steel slabs which leave the slabbing mill or the continuous caster. In cooling from an initial temperature of approximately 1800° F. to room temperature, approximately 550,000 BTU is wasted per ton of steel.

It is possible to conserve the sensible heat of slabs by performing subsequent finishing operations without intermediate cooling. However, in this case hot scarfing must be employed to condition the surfaces of the slabs, and hot scarfing, by virtue of its consumption of natural gas and oxygen, and because it removes an excess of metal from the slabs, uses at least as much energy as it saves in the sensible heat of said slab. Thus there is no saving of energy in the use of hot scarfing.

In the United States, where the annual production of slabs is approximately 60 million tons, the loss of energy in the slabs amounts to $24\times10^{12}$ BTU per year, equivalent to almost 4,000,000 barrels of oil. Similar calculations can be applied to other semi-finished products, castings, finished products and the like, both ferrous and non-ferrous.

A purpose of this invention is to convert to a useful form the energy which is released from the cooling of metal slabs and other metal products.

A further purpose of this invention is to produce steam from the energy which is released from the cooling of metal slabs and other metal products.

A further purpose of this invention is to produce steam from or to convert to another useful form the energy which is released from the cooling of metal slabs and other metal products and to do so in an essentially continuous manner.

A further purpose of this invention is to provide accelerated cooling of metal slabs and other metal products.

SUMMARY OF THE INVENTION

To achieve the foregoing objects and in accordance with the purpose of the invention, as embodied and broadly described herein, metal products that are hot from a shaping process are cooled and the heat from these products is removed as a useful form of energy in a process comprising: transporting the metal products through a cooling chamber; and absorbing the heat from the metal products into a heat absorber for making further use of the heat. The heat is preferably absorbed from the metal products into a heat absorber by circulating a cooling gas past the metal products to heat the cooling gas, circulating the heated cooling gas past heat transfer surfaces to cool the cooling gas and transfer its heat to the heat transfer surfaces, transferring heat from the metal products to the heat transfer surfaces directly by radiation, and transferring heat from the heat transfer surfaces into the heat absorber. In a preferred embodiment, the heat absorber is water that is converted into steam by absorbing heat from the heat transfer surfaces.

The apparatus for achieving the foregoing objects in accordance with the purpose of the invention, as embodied and broadly described herein, comprises an enclosed cooling chamber into which the metal products are placed for cooling; means for transporting the metal products through the cooling chamber; and means for absorbing heat from the metal products into a heat absorber for making further use of the heat. The means for absorbing heat preferably comprises means for circulating cooling gas in the cooling chamber for removing heat from the metal products and heating the gas, means for preventing loss of the cooling gas from the cooling chamber, heat-transfer surfaces for cooling the heated gas and transferring its heat to the heat-transfer surfaces, and means within the heat-transfer surfaces for transferring heat into the heat absorber.

In the drawings, which are incorporated in and constitute a part of this specification, I have chosen to illustrate one of the numerous embodiments in which the invention may appear, selecting the forms shown from the standpoints of convenience in illustration, satisfactory operation, and clear demonstration of the principles involved.

DESCRIPTION OF THE PREFERRED EMBODIMENTS

As stated heretofore, in the prior art the steel slab is cooled without the recovery of thermal energy. One method of cooling that is in common use is to place the slabs in piles and allow the heat of the slabs to be radiated to the atmosphere. In addition to wasting the heat, this method incurs the further disadvantage of being slow and of requiring a substantial period of time for the slabs to achieve final temperatures. Another prior method of cooling the slabs is to immerse them in water or to spray them with water, the purpose being to accelerate the rate of cooling. However, as in the previously mentioned method, thermal energy is wasted.

I have discovered a new process and apparatus for cooling of metal products such as slabs. In this process, the slabs are cooled in a special cooling apparatus in which the thermal energy of the slabs is transferred to a heat transfer absorber to produce steam or some other useful form of energy. This process has a further advantage in that the rate of cooling which is achieved is substantially accelerated as compared to atmospheric cooling.

Figure 1:
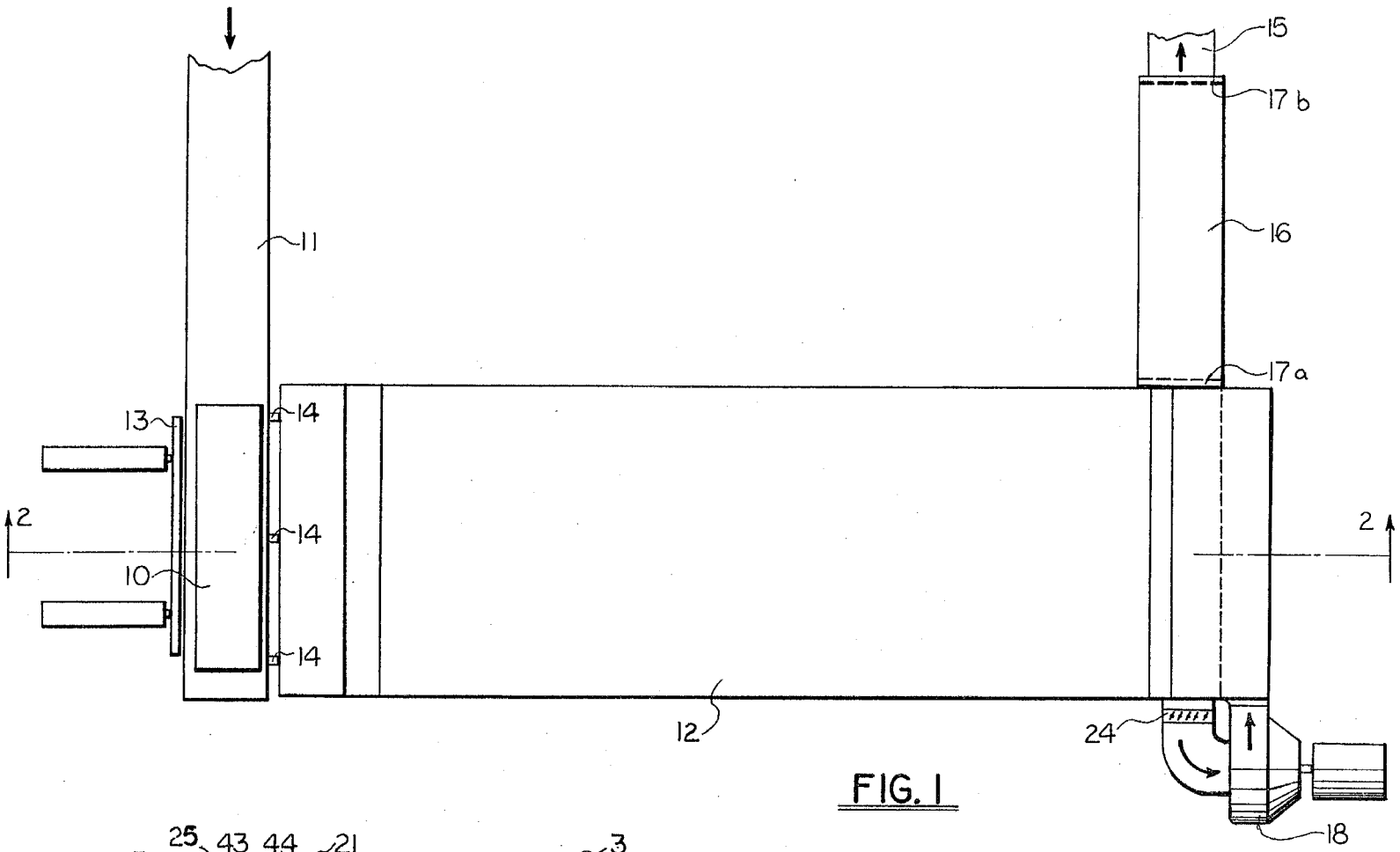
FIG. 1 is a plan view of the apparatus for cooling metal slabs and recovering thermal energy therefrom.
Figure 2:
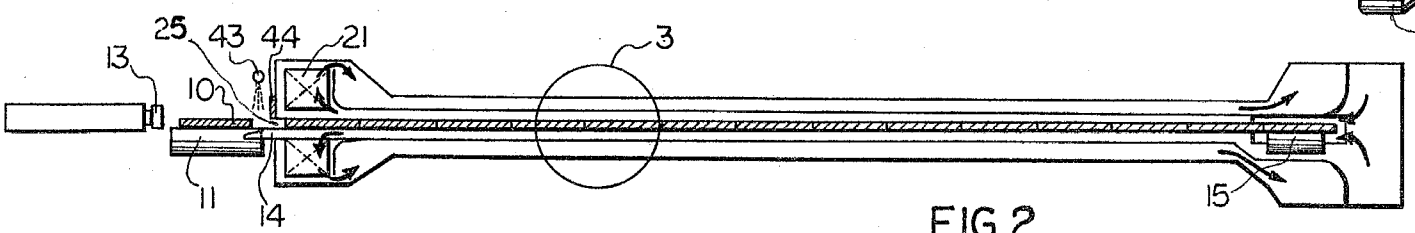
FIG. 2 is a cross-section on line 2—2 of FIG. 1.
Figure 3:
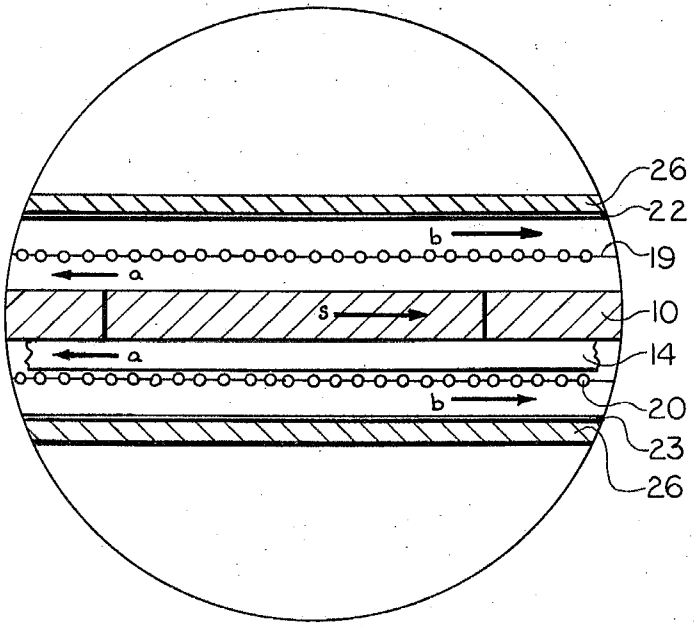
FIG. 3 is an enlargement of area 3 of FIG. 2.

First considering the drawings of FIGS. 1, 2 and 3, the slab 10 is delivered at elevated temperatures from the rolling mill or the continuous caster by means of the entry conveyor 11. The entry conveyor, in its usual form, is a roller conveyor as shown. The slab is stopped in front of the entry end of the cooling chamber 12. A slab pusher 13 then moves the slab into the cooling chamber, thereby pushing ahead of the slab all of the slabs which had previously been placed within the cooling chamber. The slabs, in moving through the cooling chamber, are supported on several slab support skids 14. At the delivery end of the cooling chamber 12 which is opposite from the slab pusher 13, there is a delivery conveyor 15 which removes the end-most of the slabs 10 and transports it endwise into an exit pressure lock 16. The exit pressure lock is equipped with a pair of air-tight doors 17*a* and 17*b*, one at each end of the pressure lock.

In discharging a slab 10 from the cooling chamber 12, door 17*a* is opened so that the slab may pass into the exit pressure lock 16. When the slab is in the pressure lock, door 17*a* is closed and door 17*b* is opened. The delivery conveyor 15 may then be operated so as to discharge the slab from the exit pressure lock. In this manner, slabs 10 may be removed one at a time from cooling chamber 12 without leakage of air from the cooling chamber to the atmosphere. After removal of each one of the slabs from the cooling chamber, a new one of the slabs is pushed into the cooling chamber.

At the delivery end of the cooling chamber 12, there is a circulating fan 18. This fan delivers air into the cooling chamber, where the air passes between the upper boiler tube membrane 19 and the row of slabs 10 as well as between the row of slabs 10 and the lower boiler tube membrane 20. The boiler tube membranes comprise a plurality of boiler tubes arranged with interconnecting plate members to form a boiler membrane wall. A heat absorbing medium flows through the boiler tubes. The direction of air flow is shown by arrows designated as a in FIG. 3, and the motion of the slabs 10 is shown by the arrow designated as s. Efficient, counter-current flow between the circulating air and the slabs 10 optimizes heat transfer between the air and the slabs. When the air reaches the entry end of the cooling chamber it passes through the superheater 21 and returns through the annular space formed by the upper casing 22 and the upper boiler tube membrane 19, as well as by the annular space formed by the lower casing 23 and the lower boiler tube membrane 20. After leaving the annular spaces, the air passes through pressure control damper 24 and reenters the circulating fan 18.

Leakage of circulating air from the cooling chamber 12 is prevented by several features in the construction of the cooling chamber. First, the cooling chamber has an air-tight casing to which the circulating fan 18 is tightly connected by duct work. Second, the pressure control damper 24 is automatically regulated so as to produce an essentially neutral atmospheric pressure at the entry slot 25 of the cooling chamber. Third, the loss of air at the discharge end of the cooling chamber is prevented by means of the exit pressure lock 16 with its air-tight doors 17*a* and 17*b*.

The cooling of the slabs 10 is accomplished by the transfer of heat from the slabs to the upper boiler tube membrane 19 and to the lower boiler tube membrane 20 by two heat transfer mechanisms, namely radiation and convection. Radiation heat transfer takes place directly from the surface of the slabs to the surface of the boiler tube membranes. Convection heat transfer takes place from the slabs to the circulating air and from the circulating air to the boiler tube membranes. Convection heat transfer from the circulating air to the boiler tube membranes takes place on both sides of the membranes, that is, the sides that face the slabs and the sides that face the upper and lower casings 22 and 23. The casings are provided with thermal insulation 26 to retard the flow of heat through the casings and to improve the thermal efficiency of the process.

Figure 4:
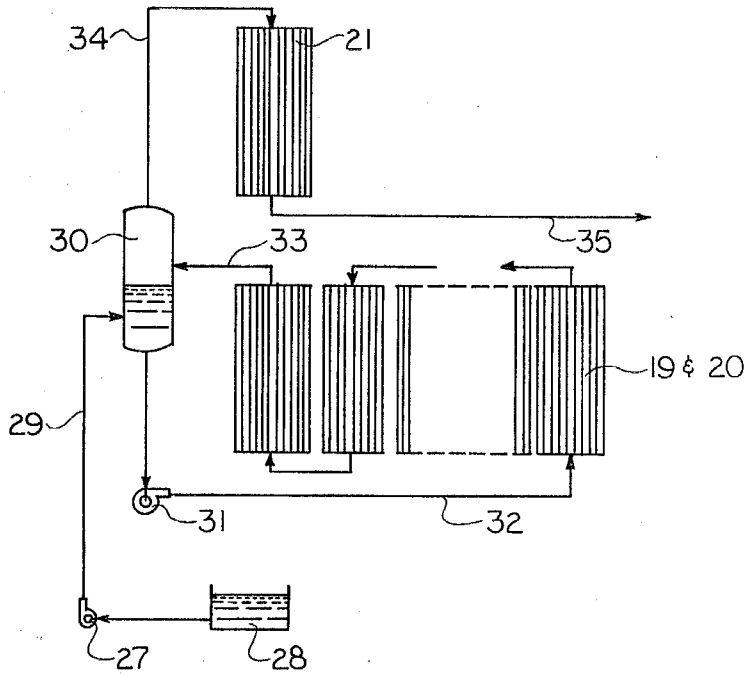
FIG. 4 is a diagram of the steam generating circuit which is employed in the apparatus for cooling metal slabs.

The diagram of FIG. 4 shows a circuit for recovering the heat energy which is transferred from the slabs 10 to the upper boiler tube membrane 19, the lower boiler tube membrane 20 and the superheater 21. In the diagram, feed pump 27 delivers boiler feed water 28 through pipe 29 to separator drum 30. Circulating pump 31 circulates the water to the upper boiler tube membrane 19 and the lower boiler tube membrane 20 by means of pipe 32. A mixture of steam and water leaves the boiler tube membranes by means of pipe 33 and returns to the separator drum. Steam from the separator drum is delivered to superheater 21 by means of pipe 34 and from the superheater to the ultimate point of use by pipe 35.

The diagram of FIG. 4 comprises a typical circuit for utilizing heat to convert boiler feed water to superheated steam. In accordance with the invention, various commercially available operating controls and instruments may be utilized as desired and appropriate to the service. Other boiler circuits may also be applied to achieve the desired end result of producing useful steam from the heat which is transferred from the slabs 10 to the heat transfer surfaces 19 and 20.

Figure 5:
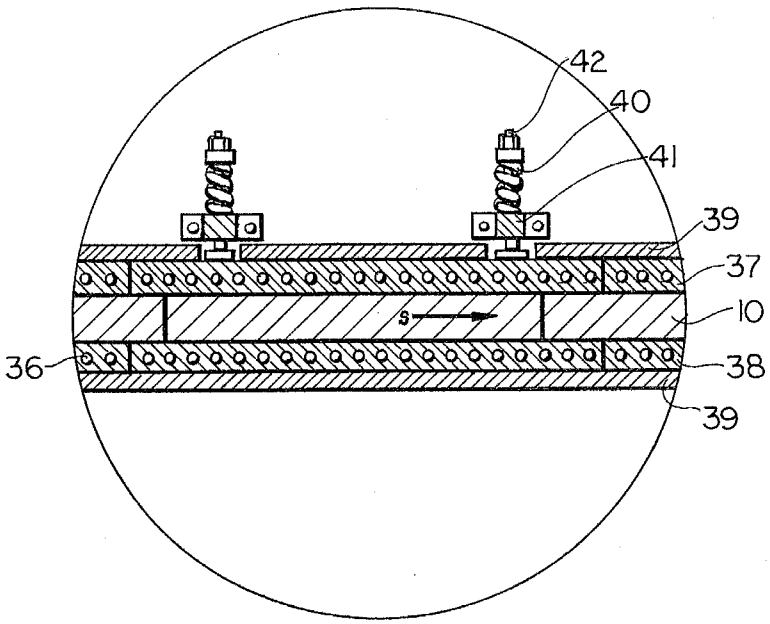
FIG. 5 shows an alternative to the arrangement of FIG. 3 in which heat is transmitted from the slab to the heat transfer surfaces by means of direct conduction.

FIG. 5 shows an alternative arrangement in accordance with the invention in which the transfer of heat from the slabs 10 to the boiler feed water is accomplished essentially by conductive heat transfer. In this arrangement, the boiler feed water is circulated through conduits 36 which are internal to the upper boiler contact plates 37 and the lower boiler contact plates 38. The slabs 10 rest upon and slide over the lower boiler contact plates 38, which are stationary. The upper boiler contact plates 37, in turn, rest upon the upper surface of the slabs and are also stationary. The entry ends of the upper boiler contact plates are chamfered to assure smooth passage of the slabs below them and to provide automatic adjustment for such changes in the thickness of the slabs as may occur in practice. Springs 40, which rest upon and are supported by spring supports 41, act through spring rods 42 to partially balance the weight of the upper boiler contact plates 37, thereby reducing the frictional drag between the contact plates and the slabs 10.

Thermal insulation 39 is placed on the exterior surfaces of the upper boiler contact plates 37 and the lower boiler contact plates 38. The purpose of the thermal insulation is to retard the flow of heat from the process to the atmosphere and thereby increase the efficiency of the process. Because heat is transferred by conduction, there is no necessity to provide a circulating fan or duct work.

The arrangement of FIG. 5 is particularly adapted to the cooling of metal slabs, metal plates, metal strips and other flat metal products which are relatively free of waves, bumps, and other surface projections. In contrast, the arrangement of FIG. 3 may be used on flat products which have surface projections, or it may be used for the cooling of such contoured metal products as pipes, structural shapes, etc.

The purpose of the invention may be served by various alternatives to those described and illustrated. For example, the heat which is transferred from the slabs 10 may be used to heat a gas or air instead of converting boiler feed water 28 to steam, or it may be used to generate electricity directly by means of a thermo-electric converter.

The heating of gas or air may be achieved by passing the gas or air through the heat transfer surfaces, or the heat transfer surfaces may be dispensed with and the air or gas heated by passing the gas or air directly over the slabs, all or a portion of the gas being withdrawn.

Additionally, a curtain of air may be supplied through pipe 43 (FIG. 2) to minimize the outward leakage of circulating air from the entry end of the cooling chamber 12. This flow of air may be further reduced by the provision at the entry end of the cooling chamber of a vertically sliding door 44, the door being opened only when it is desired to push a new slab 10 into the cooling chamber. Additionally, other means of conveying the slab through the cooling chamber may be provided, typical of such conveying means being oscillating conveyors, chain conveyors, walking beams, etc., in accordance with construction and practices which are common to commercially available industrial furnaces. Additionally, the products to be cooled, in being transported through the cooling chamber, may have their axes oriented in various directions with respect to the direction of motion; for example, the axis of a product may be aligned parallel to the direction of motion.

It will be apparent to those skilled in the art that various modifications and variations could be made in the process and apparatus of the invention for cooling metal products without departing from the scope or spirit of the invention.

What is claimed is:

1. A process for cooling metal products that are hot from a shaping process and converting the heat from said products into a useful form of energy comprising:

(a) sequentially transporting a plurality of said metal products through a cooling chamber in substantially a single direction;

(b) circulating a cooling gas between said metal products and heat transfer surfaces that extend along substantially the entire length of said cooling chamber in countercurrent flow with said metal products and recycling said cooling gas in a concurrent direction in contact with the side of said heat-transfer surfaces opposite the side facing said metal products thereby transferring heat from said metal products to said cooling gas and from said cooling gas to said heat transfer surfaces;

(c) transferring heat from said metal products to said heat transfer surfaces directly by radiation; and (d) transferring heat from said heat transfer surfaces into water to thereby convert said water into steam.

2. The process of claim 1, further comprising passing steam from said heat-transfer surfaces to a superheater and superheating said steam in said superheater by heat exchange with heated cooling gas after countercurrent flow and before concurrent flow of said cooling gas.

3. The process of claim 1, wherein said heat-transfer surfaces comprise a plurality of boiler tubes arranged with interconnecting plate members to form a boiler tube membrane wall and wherein said water is caused to flow through said boiler tubes.

4. The process of claim 1, wherein loss of said cooling gas is minimized from said cooling chamber by delivering said metal products from said cooling chamber through an exit pressure lock and by controlling the pressure of said cooling gas at essentially neutral atmospheric pressure within the entry end of said cooling chamber.

5. The process of claim 4, wherein the loss of said cooling gas at said entry end is further minimized by causing an air curtain to flow across the entry opening into said cooling chamber.

6. The process of claim 5, wherein the loss of said cooling gas at said entry end is further minimized by closing a door over the entry opening once said metal products have been placed within said cooling chamber.

7. The process of claim 1, wherein said metal products are transported through said cooling chamber by pushing them through said cooling chamber on skids and delivering them from said cooling chamber by means of a discharge conveyor.

8. A process for cooling metal products that are hot from a shaping process and converting the heat from said products into a useful form of energy comprising:

(a) sequentially transporting a plurality of said metal products through a cooling chamber in substantially a single direction;

(b) directly contacting said metal products with heat-absorbing plates in said cooling chamber to transfer heat to said heat-absorbing plates by direct conduction from said metal products; and (c) transferring heat from said heat-absorbing plates into a heat absorber.

9. The process of claim 8, wherein said heat absorber is water and step (c) comprises converting said water into steam by absorbing said heat from said heat-absorbing plates.

10. The process of claim 8, wherein said metal products in said cooling chamber rest upon and slide over lower heat-absorbing plates and simultaneously support upper heat-absorbing plates that automatically adjust to changes in the thickness of the metal products.

* * * * *